US009429386B2

(12) United States Patent
Leykin

(10) Patent No.: US 9,429,386 B2
(45) Date of Patent: Aug. 30, 2016

(54) ADVANCED MUZZLELOADER SYSTEM

(71) Applicant: Vadim Leykin, Bronxville, NY (US)

(72) Inventor: Vadim Leykin, Bronxville, NY (US)

( * ) Notice: Subject to any disclaimer, the term of this patent is extended or adjusted under 35 U.S.C. 154(b) by 0 days.

(21) Appl. No.: 14/867,916

(22) Filed: Sep. 28, 2015

(65) Prior Publication Data

US 2016/0091275 A1 Mar. 31, 2016

Related U.S. Application Data

(60) Provisional application No. 62/056,504, filed on Sep. 27, 2014.

(51) Int. Cl.
*F41C 9/08* (2006.01)
*F41A 21/00* (2006.01)

(52) U.S. Cl.
CPC *F41C 9/08* (2013.01); *F41A 21/00* (2013.01)

(58) Field of Classification Search
CPC ..... F41C 9/08; F41C 9/085; F41C 3/02
USPC ..... 42/51; 89/1.3
See application file for complete search history.

(56) References Cited

U.S. PATENT DOCUMENTS 5,313,732 A * 5/1994 Peifer ..... F41A 19/39 42/51
5,333,403 A * 8/1994 Peifer ..... F41A 19/39 42/51
7,257,917 B1 * 8/2007 Garland ..... F41A 15/00 42/46
2012/0318123 A1 12/2012 Worrell et al.
2014/0090285 A1 4/2014 Peterson et al.

* cited by examiner

*Primary Examiner* — Reginald Tillman, Jr.
(74) *Attorney, Agent, or Firm* — Davidson, Davidson & Kappel, LLC

(57) ABSTRACT

A muzzleloader system is provided. The muzzleloader system includes a barrel with a muzzle and chamber end, a chamber block including a flash channel, a rotating primer holder and a round having a reusable inert projectile body with a sealed propellant charge. The method includes loading a round having a reusable inert projectile body and a sealed propellant charge down the muzzle end of a barrel bore until it abuts against a chamber block, loading a primer into a rotatable primer holder, closing the primer holder and striking the primer with a firing pin.

5 Claims, 4 Drawing Sheets

ADVANCED MUZZLELOADER SYSTEM

This claims the benefit of U.S. Provisional Patent Application No. 62/056,504 filed Sep. 27, 2014, which is hereby incorporated by reference herein.

The present disclosure relates generally to muzzleloader firearms and specifically to a muzzleloader firearm with a rotating primer holder.

BACKGROUND

Modern firearms typically use cartridges consisting of metal cases holding a projectile placed over a smokeless propellant charge with a primer used as the ignition source. When the primer is struck it ignites the propellant and fires the projectile. The expended cartridge is then ejected either manually or automatically prior to the next cartridge being loaded and fired. Typically a metal cartridge can be reused while the fired projectile cannot. A muzzleloader firearm is a type of firearm that requires multiple ammunition components to be loaded down the front end of the barrel, also known as the muzzle. Before each and every shot a typical muzzleloader user must load a propellant charge and a projectile down the muzzle of the firearm. The ignition source for muzzleloader firearms can vary greatly ranging from primers and percussion caps to a traditional flintlock design. The propellant charge is loaded into the barrel in either a granular form or as a premeasured consolidated pellet form.

Most muzzleloader propellant charges are hygroscopic compounds. Therefore an unsealed propellant charge may allow moisture to be absorbed into the propellant charge. Propellant moisture absorption may cause inconsistent ignition, reduced accuracy, inconsistent velocity and firearm corrosion. Furthermore, moisture absorption may cause the propellant burn rate to be reduced thereby altering pressure and velocity characteristics of the firearm.

U.S. Pat. Pub. 2014/0090285 A1 describes a muzzleloader bullet system including a pre-packaged propellant charge and a primer for providing efficient loading and unloading of the muzzleloader. U.S. Pat. Pub. 2012/0318123 A1 describes an encapsulated propellant charge for a muzzleloader.

SUMMARY OF THE INVENTION

A muzzleloader system is provided. According to a first aspect of the invention the muzzleloader system includes a barrel including a muzzle end and a chamber end; and a primer holder configured for holding a primer. The primer holder being movably connected to the chamber end such that the primer holder is movable between a closed orientation in which the primer holder is aligned with the barrel and an open orientation in which the primer holder protrudes from the barrel for loading the primer into the primer holder.

The primer holder may include a lock for locking the swing plate in the closed orientation, the lock being actuatable by an operator to release the swing plate from the closed orientation.

A muzzleloader system according to a second aspect of the invention is also provided. The muzzleloader system includes a barrel including a muzzle end and a chamber end. The barrel including a hollow bore formed therein; and a round loadable into the hollow bore. The round including a reusable body including a propellant cavity formed therein configured for receiving a propellant charge.

A method of operating the muzzleloader system is also provided. The method includes providing a round into a bore formed in a barrel by inserting the round into a muzzle end of the barrel. The round including a reusable body including a propellant cavity formed therein housing a first propellant charge. The round further including a first cover attached to the reusable body holding the propellant charge in the propellant cavity. The method further includes activating the propellant charge to propel the round from the barrel; inserting a second propellant charge into the propellant cavity of the reusable body; and activating the second propellant charge to propel the round from the barrel.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

The present disclosure provides a muzzleloader system that uses reloadable rounds with a sealed internal propellant charge to be loaded through a muzzle. The muzzleloader system further includes a rotating swing out primer holder action at the chamber and thereby allowing a primer to be loaded and unloaded quickly and easily. The muzzleloader system provides greater loading speed, consistency and moisture resistance. Instead of a typical muzzleloader system that involves muzzle loading either a powdered propellant or consolidated propellant charge before loading a projectile on top of the propellant charge, the current muzzleloader system uses a round with a self-contained propellant charge.

Figure 1:
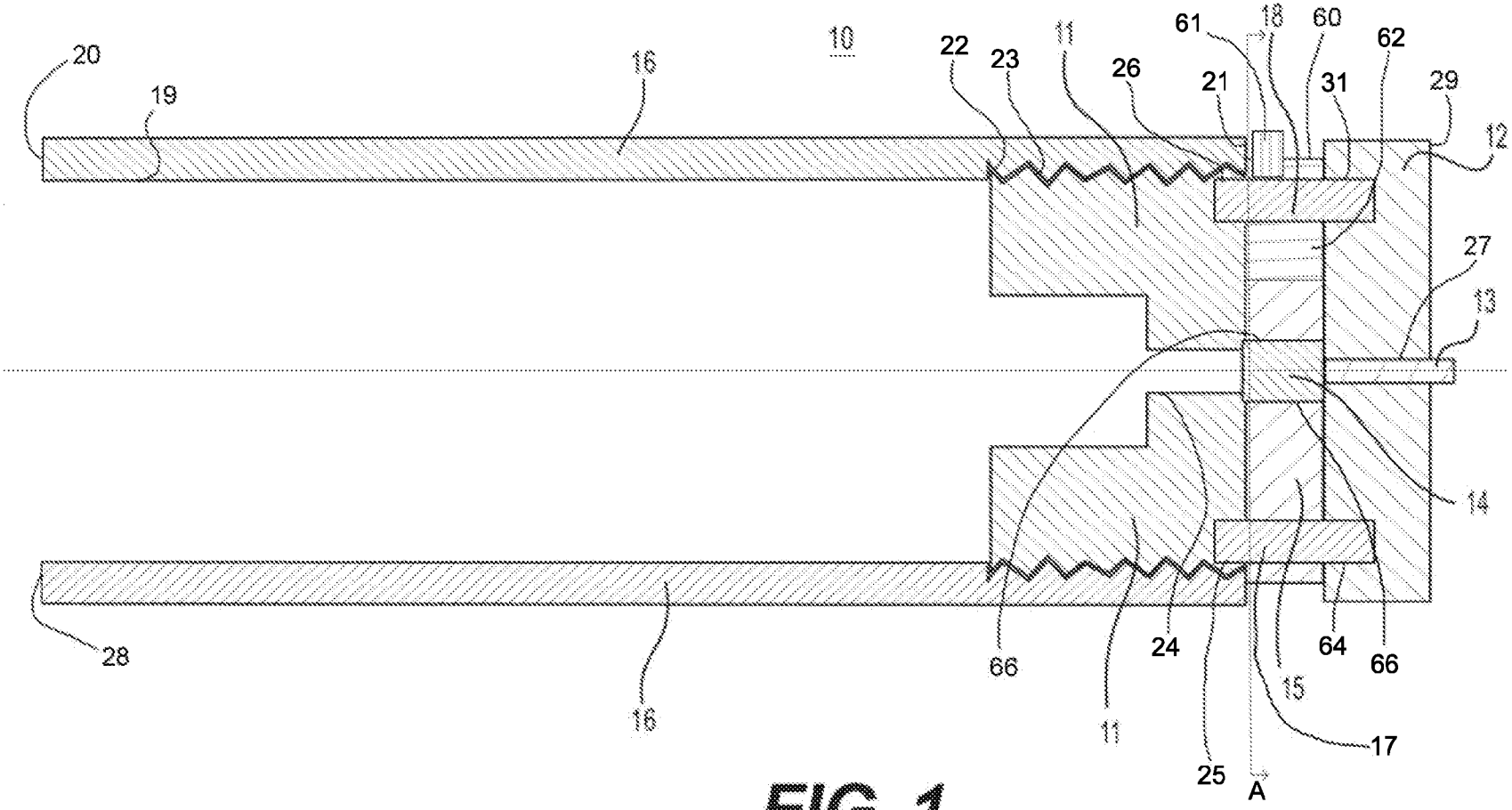
FIG. 1 shows a radial cross section view of a muzzleloader system according to one embodiment of the present invention.

FIG. 1 shows a radial cross-sectional view of a muzzleloader system 10 according to one exemplary embodiment of the present invention. The muzzleloader system 10 includes a front end 28 located at a muzzle 20 of a cylindrical barrel 16, a rear end 29 being located at the axial opposing end of the muzzleloader system at a primer recoil plate 12. The barrel surrounds and defines a hollow bore 19. The bore 19 is radially centered within the barrel 16 and extending axially through the barrel 16. The barrel 16 extends axially having two axially opposing open ends. One end is the muzzle 20 and the other end is a chamber end 21. The chamber end 21 includes a threaded portion 22 along an interior circumference thereof configured to accept a chamber block 11. The chamber block 11 is correspondingly sized and threaded along a threaded exterior circumference 23 thereof to engage the threaded portion 22 of the chamber end 21. The chamber block 11 is removably attached to barrel 16 along threaded portion 22. The chamber block 11 includes a flash channel 24 located in radial center and extends axially therethrough. The chamber block 11 further includes two diametrically opposed cutout channels extending axially into chamber block 11. The opposed cutout channels are a first chamber block channel 25 and a second chamber block channel 26. A first fastener in the form of a first connecting bolt 17 and a second fastener in the form of a second connecting bolt 18 are received in and connected to the first chamber block channel 25 and the second chamber block channel 26, respectively. Each of the two connecting bolts 25, 26 extends axially away from the respective chamber block channel 25, 26 toward the rear end 29.

A primer holder 60 is located to the rear of the chamber block 11 and is attached to the first connecting bolt 17 and second connecting bolt 18, with the bolts 17, 18 extending axially from chamber block 11 through primer holder 60. The primer holder 60 includes a swing plate 15 and a stationary plate 62, as shown in greater detail in FIG. 2, which is described below. The swing plate 15 and stationary plate 62 are circumferentially and radially adjacent to each other within the same plane to the rear of the chamber block 11. The swing plate 15 includes a swing plate cutout 64 extending axially therethrough. The swing plate cutout 64 is located axially in line with and receives the first connecting bolt 17. The stationary plate 62 includes a stationary plate cutout 65. The stationary plate cutout 65 extends axially through the stationary plate 62 and is located axially in line with and receives the second connecting bolt 18.

The swing plate 15 is rotatably connected to chamber block 11 via the first connecting bolt 17. Swing plate 15 is located axially between and directly adjacent to chamber block 11 and primer recoil plate, to the rear of the chamber block 11 and in front of the primer recoil plate 12. The swing plate 15 is configured to rotate around an axis of the first connecting bolt 17. The stationary plate 62 is affixed in place with second connecting bolt 18 creating a mechanical connection with the stationary plate cutout 65. Stationary plate 62, like swing plate 15, is located axially between and directly adjacent to chamber block 11 and primer recoil plate, to the rear of the chamber block 11 and in front of the primer recoil plate 12.

The swing plate 15 includes a primer pocket 66 which extends axially therethrough and is located at a radial center of the swing plate 15. The primer pocket 66 is axially in line with the flash channel 24. The primer pocket 66 is configured to receive a primer 14. The primer recoil plate 12 is located at the rear end 29 of the muzzleloader system 10. The primer recoil plate 12 includes a first primer recoil plate cutout 30 and a second primer recoil plate cutout 31, both of which extending axially into primer recoil plate 12. The first primer recoil plate cutout 30 and the second primer recoil plate cutout 31 line up axially with the first connecting bolt 17 and the second connecting bolt 18, respectively. The first primer recoil plate cutout 30 is configured to receive first connecting bolt 17 and such that primer recoil plate 12 is mechanically connected to primer holder 62 and chamber block 11 via the first connecting bolt 17. The second primer recoil plate cutout 31 is configured to receive second connecting bolt 18 such that primer recoil plate 12 is connected to primer holder 62 and chamber block 11 via the second connecting bolt 18. The primer recoil plate 12 includes a firing pin cutout 27. The firing pin cutout 27 is located in the radial center of the primer recoil plate 12 and extends axially therethrough. The firing pin cutout 27 lines up axially with the primer pocket 66 and is configured to allow a firing pin 13 to move freely in an axial direction through the firing pin cutout 66 and strike the primer 14 in the primer pocket 66.

Figure 2:
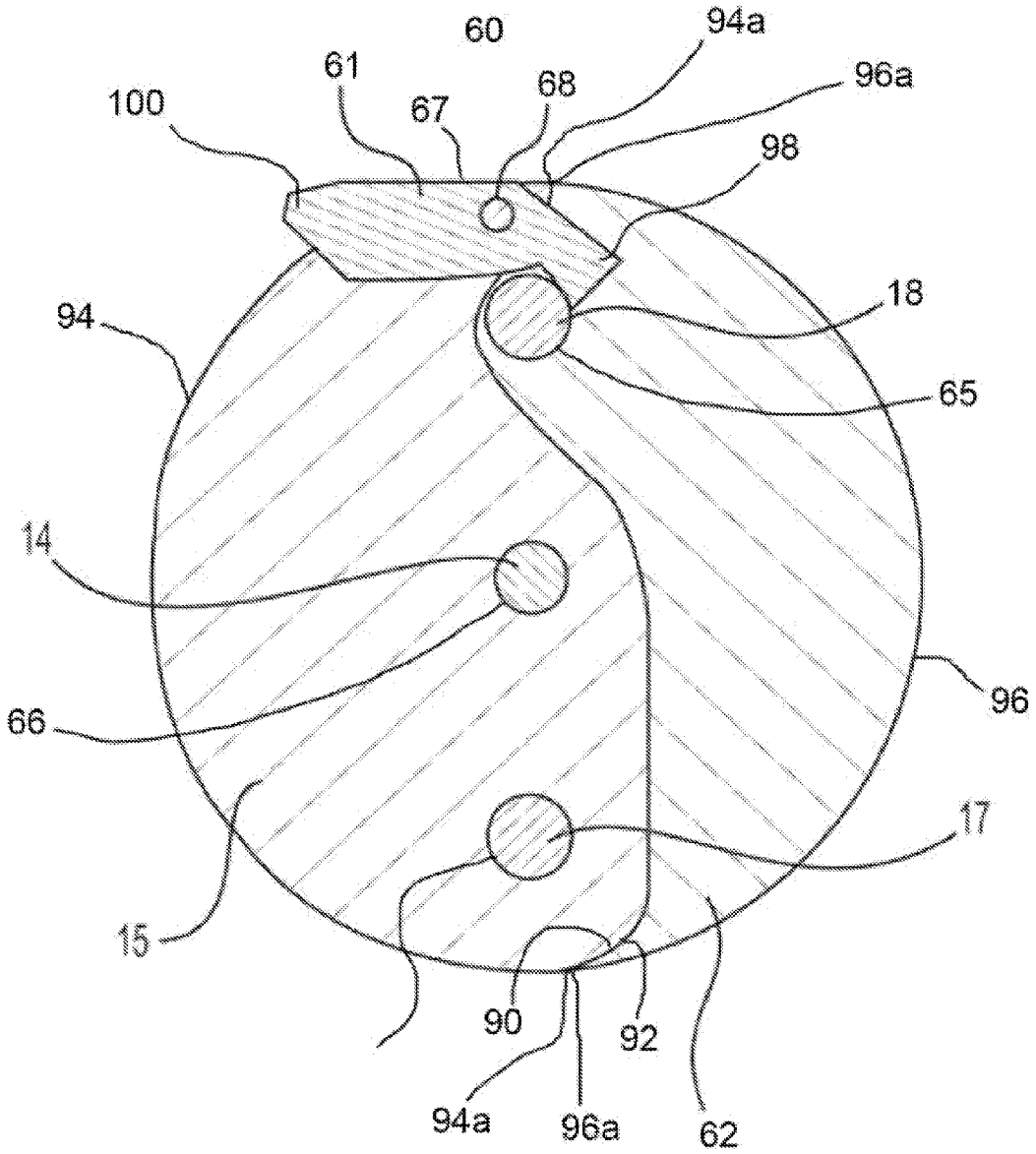
FIG. 2 shows an axial cross section view of a primer holder according to one embodiment of the present invention.

FIG. 2. Shows an axial cross-sectional view of a primer holder 60 of the muzzleloader system 10 from one exemplary embodiment of the present invention along A-A in FIG. 1. The primer holder 60 includes swing plate 15 and stationary plate 62. As shown in FIG. 2, the swing plate 15 and stationary plate 62 are radially and circumferentially adjacent to each other within the same plane. The swing plate 15 includes swing plate cutout 64 which extends axially therethrough at a radial center of primer holder 60. The swing plate cutout 64 receives first connecting bolt 17 such that swing plate 15 is rotatably connected to first connecting bolt 17. The stationary plate 62 includes stationary plate cutout 65. The stationary plate cutout 65 receives second connecting bolt 18. The swing plate 15 is configured to rotate around a center axis of the first connecting bolt 17, as permitted by circumferential contact between an interior circumferential edge 90 of swing plate 15 and an interior circumferential edge 92 of the stationary plate 62. Interior circumferential edge 90 extends radially in a curved path from a first point 94*a* of an outer circumferential surface 94 of swing plate 15 to a second point 94*a* of outer circumferential surface 94. Similarly, interior circumferential edge 92 extends radially in a curved path from a first point 96*a* of an outer circumferential surface 96 of stationary plate 62 to a second point 96*a* of outer circumferential surface 96. Interior circumferential edges 90, 92 have corresponding contours such that in a closed orientation of primer holder 60, which is shown in FIG. 2, edges 90, 92 mesh with each other. The stationary plate 62 is nonrotatably affixed in place on the second connecting bolt 18. As shown in FIG. 2, the primer pocket 66 is located in the radial center of the swing plate 15 and receives a primer 14 therein.

Primer holder 60 further includes a latch system 67. The latch system 67 includes a latch 61 rotatably attached to swing plate 15, and latch pin 63 which rotatably connects latch 61 to swing plate 15. The latch 61 includes a latch pin cutout 68. The latch pin cutout 68 extends axially through the latch 61. The latch pin 63 extends axially through the latch pin cutout 68 such that latch 61 is rotatable about latch pin 63. Latch 61 includes a nose 98 that contacts an outer circumferential surface of bolt 18 to hold the circumferential edge 90 of swing plate 15 against the circumferential edge of stationary plate 62 in the closed orientation. In order to cause primer holder 60 to go from the closed orientation to an open orientation, in which swing plate 15 is in a position such that primer pocket 66 is positioned radially outside of outer circumferences of barrel 16 and primer recoil plate 12, an outer contact surface 100 of latch 61 is pressed radially inward by the operator, such that nose is moved out of contact with the outer circumference of bolt 18, such that point 94*a* of swing plate 15 is movable away from stationary plate 62 as swing plate 15 is rotated about bolt 17. In the open orientation, the operator may advantageously access primer pocket 66 and primer 14 may be viewed or removed and replaced.

Figure 3:
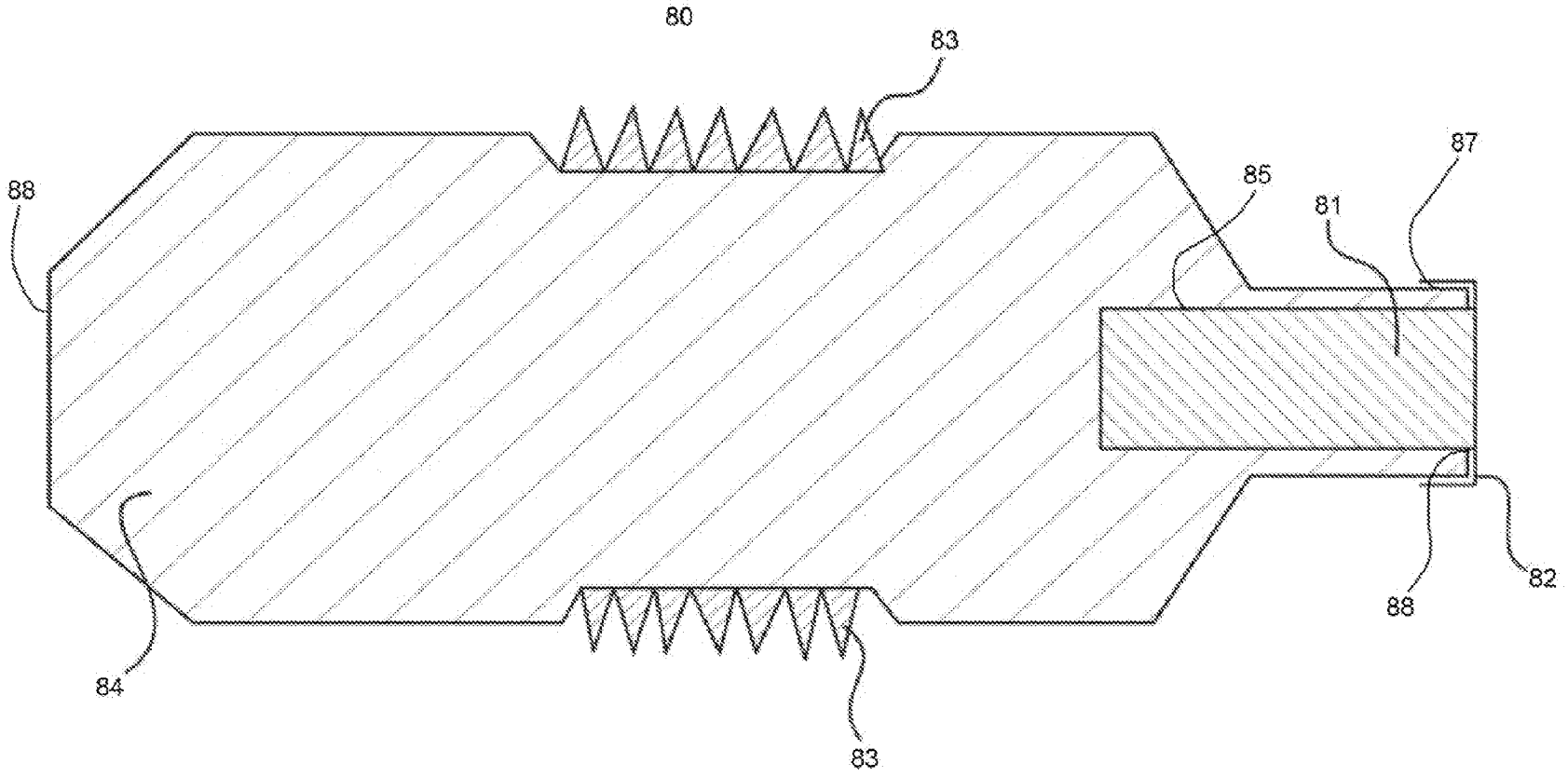
FIG. 3 shows a radial cross section view of a round of the muzzleloader system according to one embodiment of the present invention.

FIG. 3. shows a radial cross-sectional side view of a round 80 of the muzzleloader system 10 from one exemplary embodiment of the present invention. The round 80 includes a reusable inert projectile body 84. The inert projectile body 84 has an elongated generally cylindrical shape. The inert projectile body 84 has a front portion 86 and a rear portion 87 on axial opposing ends. The inert projectile body 84 includes a plurality of stabilizing fins 83 located circumferentially around the inert projectile body 84. The plurality of stabilizing fins 83 are axially located between the front portion 86 and the rear portion 87. The rear portion 87 includes a propellant cavity 85. The propellant cavity 85 is formed as a blind hole having a generally cylindrical shape with an opening 88. The propellant cavity 85 is configured to contain propellant charge 81. The propellant charge 81 and the opening 88 are sealed by a cover 82. The cover 82 is configured and designed to act as a moisture barrier. Round 80 is loaded through the muzzle 20 of barrel 16. Round 80 being orientated in such a way that the rear portion 87 enters the muzzle 20 before the front portion 86. The loading of round 80 is complete when cover 82 abuts against flash channel 24 of the chamber block 11. The inert projectile body 84 is reloadable with another propellant charge, which can be sealed with another cover and fired again. The inert projectile body 84 is the only reusable component of round 80. The inert projectile 84 may be reloaded by inserting another propellant charge, which may be the same material or a different material as the previously used propellant charge, into the propellant cavity 85. The opening 88 to propellant cavity 85 is then sealed by placing and affixing a new cover over the opening 88. The new cover is affixed in place to the rear portion 87 surrounding and covering opening 88. The new cover may be affixed through the use of an adhesive. Once the new cover has sealed opening 88, round 80 is ready to be loaded through the muzzle 20, using the aforementioned method.

Figure 4:
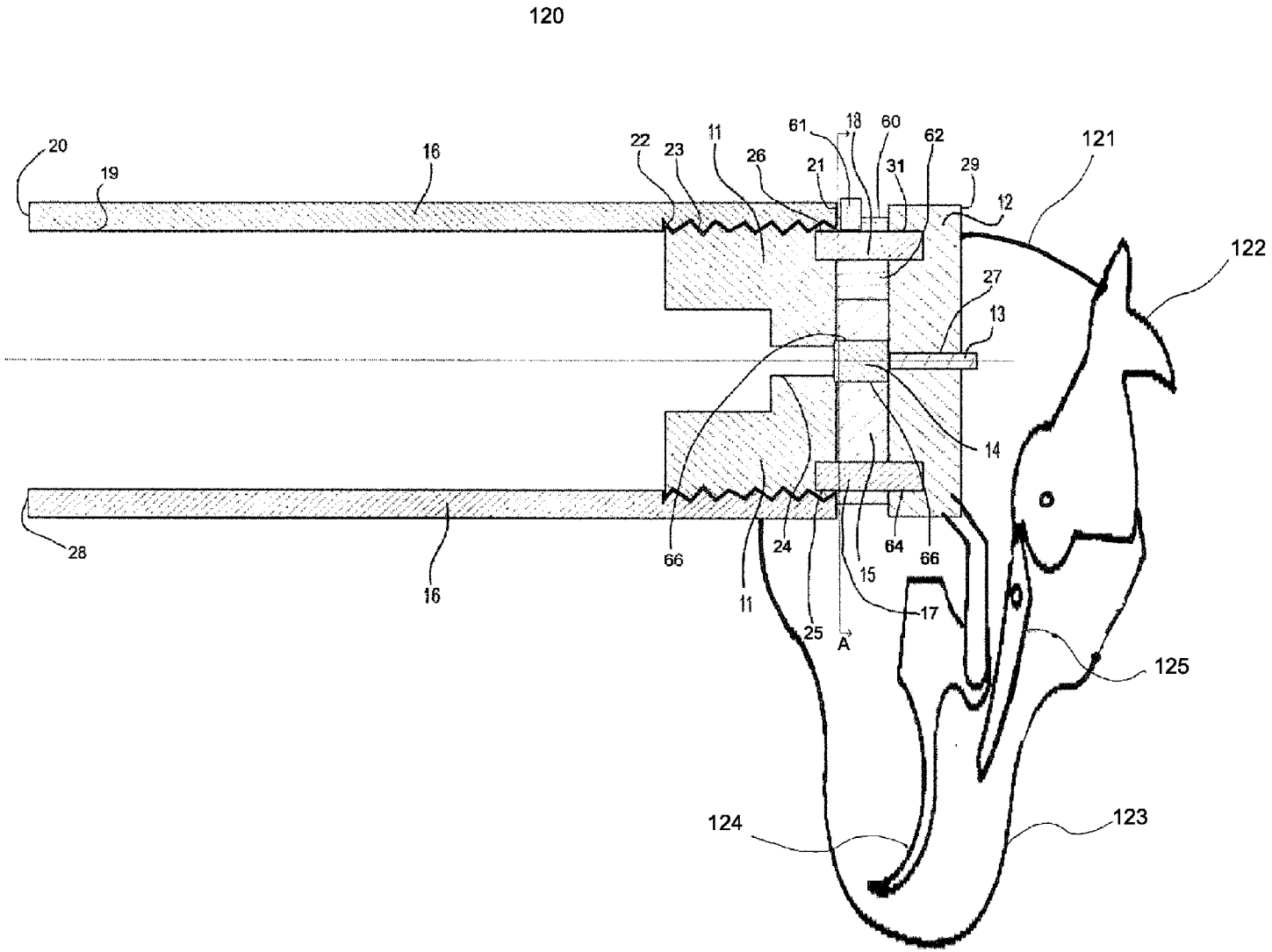
FIG. 4 shows a radial cross section view of a muzzleloader system according to one embodiment of the present invention as part of a muzzleloader firearm.

FIG. 4 shows an axial cross section view of the muzzleloader system 10 according to one embodiment of the present invention as part of a muzzleloader firearm 120. FIG. 4 uses the same reference numerals as FIG. 1 unless introduced herein. The muzzleloader firearm includes a housing 121, a hammer 122, a trigger guard 123, a trigger 124 and a hammer sear 125.

A round is fired from the muzzleloader system when an operator aims at a target and pulls a trigger 124. Actuation of the trigger 124 releases a hammer sear 125 causing a hammer spring to drive a hammer 122 forward toward the firing pin 13. The hammer 122 strikes firing pin 13 causing it to quickly move forward through the firing pin cutout 27 and strike the primer 14. Upon receiving the impact primer 14 ignites causing a flame to go through flash channel 24. The flame reaches the cover 82 causing it to burn, allowing the flame to reach the propellant charge 81. Propellant charge 81 ignites rapidly generating a volume of hot, high-pressure gas. The gas pushes the round 80 through the bore 19 at high speed until round 80 exits the muzzle 20 of the barrel 16. As an alternative to a hammer based mechanism a striker based mechanism may be used to ignite the primer 14.

The projectile body 84 may have a diameter between 9 mm and 90 mm based on the diameter of the bore 19 and the operators chosen use. In a preferred embodiment, the projectile body 84 diameter is 40 mm. In a preferred embodiment, the round 80 is capable of travelling at least one hundred yards when fired from the muzzleloader system.

In the preceding specification the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A muzzleloader system comprising:

a barrel including a muzzle end and a chamber end; and a primer holder configured for holding a primer, the primer holder being movably connected to the chamber end such that the primer holder is movable between a closed orientation in which the primer holder is aligned with the barrel and an open orientation in which the primer holder protrudes from the barrel for loading the primer into the primer holder, the system further comprising a round loadable into the barrel, the round including a reusable body including a propellant cavity formed therein configured for receiving a propellant charge, wherein the primer holder includes a swing plate pivotably connected to the barrel via a first fastener, the swing plate being pivotable about the first fastener to move between the closed orientation and the open orientation.

2. A muzzleloader system comprising:

a barrel including a muzzle end and a chamber end; and a primer holder configured for holding a primer, the primer holder being movably connected to the chamber end such that the primer holder is movable between a closed orientation in which the primer holder is aligned with the barrel and an open orientation in which the primer holder protrudes from the barrel for loading the primer into the primer holder, wherein the primer holder includes a swing plate pivotably connected to the barrel via a first fastener, the swing plate being pivotable about the first fastener to move between the closed orientation and the open orientation.

3. The muzzleloader system as recited in claim 2 wherein the primer holder includes a lock for locking the swing plate in the closed orientation, the lock being actuatable by an operator to release the swing plate from the closed orientation.

4. The muzzleloader system as recited in claim 3 wherein the lock includes a latch, the latch being actuatable by the operator to release the swing plate from the closed orientation.

5. A muzzleloader firearm comprising the muzzleloader system as recited in claim 2.

* * * * *